US006454618B1

(12) United States Patent
Andoh et al.

(10) Patent No.: US 6,454,618 B1
(45) Date of Patent: Sep. 24, 2002

(54) HIGH-FREQUENCY CONNECTOR WITH LOW INTERMODULATION DISTORTION

(75) Inventors: Masamichi Andoh; Hiroyuki Kubo, both of Nagaokakyo (JP)

(73) Assignee: Murata Manufacturing Co., Ltd., Nagaokakyo (JP)

( * ) Notice: Subject to any disclaimer, the term of this patent is extended or adjusted under 35 U.S.C. 154(b) by 0 days.

(21) Appl. No.: 09/634,917

(22) Filed: Aug. 9, 2000

Related U.S. Application Data

(60) Division of application No. 09/188,240, filed on Nov. 9, 1998, now Pat. No. 6,123,589, which is a continuation-in-part of application No. 09/064,736, filed on Apr. 23, 1998, now abandoned.

(51) Int. Cl.[7] ..... H01R 13/02
(52) U.S. Cl. ..... 439/886; 29/600
(58) Field of Search ..... 343/700; 174/343, 174/50, 151, 61, 60.61; 356/445; 359/350; 148/253; 362/800; 200/11 DA; 439/566, 577, 886, 757; 29/600, 601

(56) References Cited

U.S. PATENT DOCUMENTS

| | | | | |
|---|---|---|---|---|
| 3,562,597 A | * | 2/1971 | White | 343/700 |
| 3,641,498 A | | 2/1972 | Hedin | |
| 4,233,107 A | * | 11/1980 | Johnson, Sr. | 148/253 |
| 4,465,742 A | | 8/1984 | Nagashima et al. | |
| 4,714,804 A | * | 12/1987 | Yasuda | 200/267 |
| 4,935,312 A | | 6/1990 | Nakayama et al. | |
| 5,083,222 A | * | 1/1992 | Horiuti et al. | 359/350 |
| 5,096,300 A | * | 3/1992 | Horiuti et al. | 356/445 |
| 5,111,335 A | * | 5/1992 | Horiuti et al. | 359/350 |
| 5,298,683 A | | 3/1994 | Taylor | |
| 5,545,511 A | * | 8/1996 | Huderman et al. | 430/315 |
| 5,562,497 A | | 10/1996 | Yagi | |
| 5,839,924 A | | 11/1998 | Riston | |
| 5,841,331 A | * | 11/1998 | Tsujiguchi | 333/202 |
| 5,847,628 A | * | 12/1998 | Uchikoba et al. | 333/204 |
| 6,123,589 A | | 9/2000 | Andoh et al. | |

FOREIGN PATENT DOCUMENTS

| | | |
|---|---|---|
| JP | 5-179456 | 7/1993 |
| JP | 5-179457 | 7/1993 |

* cited by examiner

*Primary Examiner*—Neil Abrams
*Assistant Examiner*—J. F. Duverne
(74) *Attorney, Agent, or Firm*—Burns, Doane, Swecker & Mathis, LLP

(57) ABSTRACT

A high-frequency connector includes a housing 1 serving as an external conductor and a central conductor. The housing and the central conductor 2 are fabricated by applying electroless plating of nickel alloy containing phosphorus onto a nonmagnetic base material.

6 Claims, 1 Drawing Sheet

HIGH-FREQUENCY CONNECTOR WITH LOW INTERMODULATION DISTORTION

This Application is a divisional of Application No. 09/188,240, filed Nov. 9, 1998, now U.S. Pat. No. 6,123,589 which is a continuation-in-part of U.S. Application Ser. No. 09/064,736, filed on Apr. 23, 1998 now abandoned, the entire contents of which are incorporated by reference herein.

BACKGROUND

1. Field of the Invention

The present invention relates to high-frequency connectors used for high-frequency devices, such as high-powered, high-frequency devices.

2. Description of the Related Art

There are several conventional types of connectors used for high-frequency devices, including, for example, conductors commonly known as SMT, N, and BNC connectors. Effective use of these connectors depends on their capabilities and intended uses. Each type of connector includes a housing which serves as an external conductor, and a central conductor. Beryllium copper having high tensile strength is used as a base material for the housing and the central conductor. Further, generally, nickel plating is applied, and gold plating or silver plating is further applied on the underlying nickel-plated layer, if necessary.

When high-frequency electric currents pass through a conductor, a skin effect occurs. The skin depth decreases as the permeability of a magnetic metal increases. The skin depth (δ) is expressed by the following formula:

$$\delta=1/\sqrt{(\pi f \sigma \mu_o \mu_r)}$$

where f: frequency of high-frequency currents;

σ: electric conductivity of conductor;

$\mu_o$: vacuum permeability; and $\mu_r$: relative permeability.

As the permeability increases, the skin depth decreases and the electric current density of the surface layer increases.

Even if the base material is nonmagnetic, when strong high-frequency currents pass through a conductive channel having a magnetic conductive coating film, the electric current density of the surface layer increases abnormally and intermodulation distortion occurs.

As described above, in a conventional high-frequency connector, a nickel-plated layer is formed by electroplating to form a surface plated layer on the base material or to form a plated layer on top of which gold or silver plating is added. The nickel-electroplated layer has high permeability at high frequencies, for example, a relative permeability $\mu_r$ of approximately 3.0 at 1 GHz. Therefore, when high-level, high-frequency currents pass through the nickel-plated layer, intermodulation distortion may occur in some cases. In particular, with the miniaturization of devices, the connectors used have also been miniaturized. If the electric current density further increases, intermodulation distortion will occur more easily.

SUMMARY

Accordingly, it is an exemplary object of the present invention to provide an inexpensive high-frequency connector which suppresses the intermodulation distortion caused by the concentration of electric currents on the surface area of a conductive section.

In accordance with the present invention, at least a housing or a central conductor of a high-frequency connector is fabricated by applying electroless plating of a nickel alloy containing phosphorus onto a nonmagnetic base material. Also, the phosphorus content is set at, for example, 5–12 wt %.

In such a plated layer of the nickel alloy containing phosphorus formed by an electroless plating method, with a phosphorus content of 5–12 wt %, the phosphorus molecules molten into the nickel alloy are randomly arranged in a metastable state, and the plated layer does not substantially exhibit crystallinity, and also does not have magnetism in the direct current magnetic field. That is, the relative permeability $\mu_r$ is nearly equal to 1.0. The same properties are obtained at high frequencies used in high-frequency devices. For instance, according to the present invention, as confirmed by experimentation, at 1 GHz, $\mu_r$ is nearly equal to 1.0, with a phosphorus content of 5–12 wt %. Accordingly, if the nickel alloy containing phosphorus is applied onto the base material by an electroless plating method, the skin depth does not decrease with permeability even when high-level, high-frequency currents pass through, and the concentration of electric currents on the surface layer is moderated. Thus the intermodulation distortion can be sufficiently suppressed.

BRIEF DESCRIPTION OF THE DRAWINGS

The foregoing, and other, objects, features and advantages of the present invention will be more readily understood upon reading the following detailed description in conjunction with the drawing, in which.

DESCRIPTION OF THE PREFERRED EMBODIMENT

Figure 1:
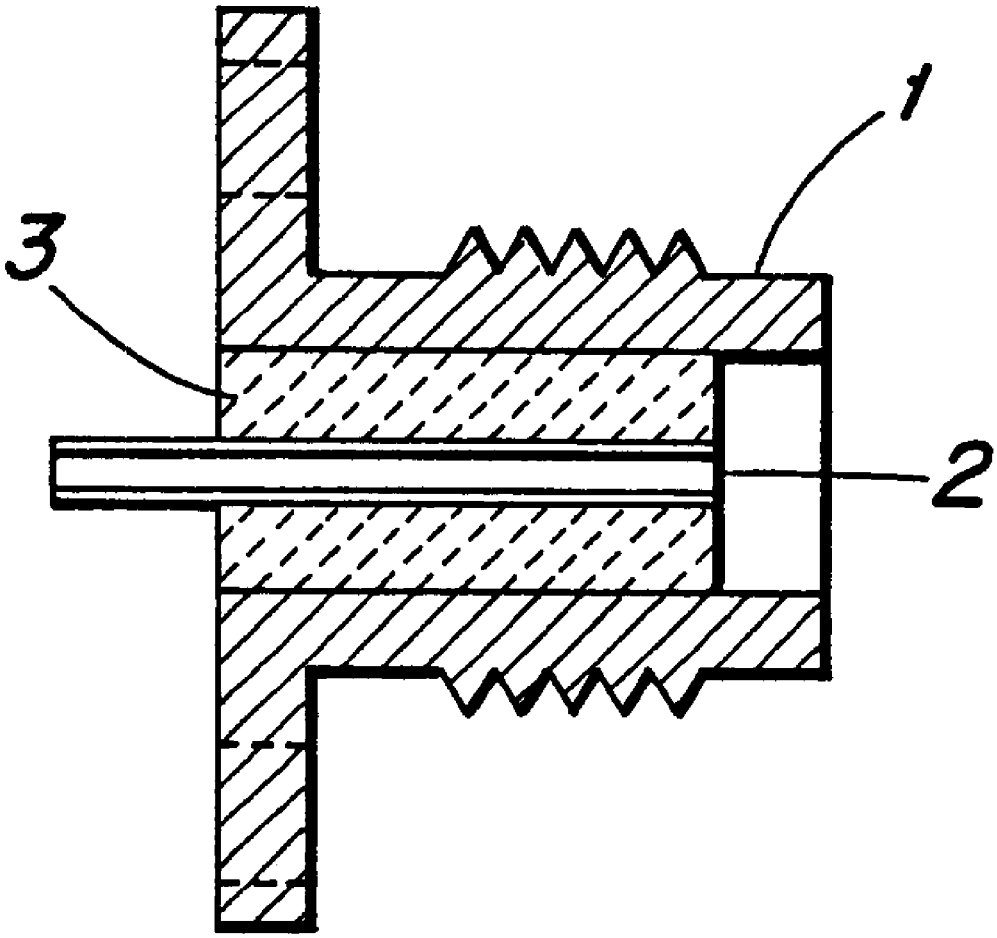
FIG. 1 is a sectional view showing an exemplary structure of a high-frequency connector.

FIG. 1 shows a structure of a high-frequency connector as an exemplary embodiment of the present invention. More specifically, this figure shows a sectional view of the high-frequency connector, which is referred to as a SMT-type coaxial connector, on the receptacle side. In the drawing, numeral 1 is a housing (which comprises an external conductor), numeral 2 is a central conductor, and numeral 3 is an insulator provided between the external conductor 1 and the central conductor 2. At least the housing 1 or the central conductor 2 include beryllium copper (beryllium bronze) as the base material. A nickel alloy layer, containing, e.g., 5–12 wt % of phosphorus, is formed as a plated layer on top of the base material. The nickel alloy layer has a thickness of approximately 2 μm, and is formed by an electroless plating method. A gold plated layer with a thickness of approximately 2 μm is formed as a surface layer, e.g., on top of the nickel alloy layer. The nickel alloy layer containing the phosphorus can be added on either the external conductor 1 or the central conductor 2, or both the external conductor 1 and the central conductor 2. Likewise, the gold plated layer can be added on either the external conductor 1 or the central conductor 2, or both the external conductor 1 and the central conductor 2.

A nickel alloy layer having 5–12 wt % phosphorus is beneficial for, the following reasons. When the phosphorus content is less than 5 wt %, permeability $\mu_r$ becomes more than 1. As described above, when permeability $\mu_r$ is more than 1, intermodulation distortion rises and the characteristics of the connector may deteriorate. Thus, the phosphorus content is preferably set at 5 wt % or more. However, when the phosphorus content is greater than 12 wt %, the nickel alloy plating can become brittle. Therefore, a phosphorus content of approximately 5–12 wt % is a preferable range. In specific exemplary embodiments, the phosphorus content can be set at 10 wt % or more, e.g., at approximately 10 wt %, or approximately 12 wt %.

The plating bath for the above-mentioned nickel-electroless plating comprises an acid-type nickel-electroless plating solution containing nickel sulfate as a metal salt, sodium hypophosphite as a reducing agent, a pH adjustor, and a stabilizer. The plating is performed at a high temperature of 80° C. or more. Thus, by the reaction of the sodium hypophosphite, the nickel layer deposited on the base material contains phosphorus. As a result, the phosphorus molecules dispersed into the nickel alloy are randomly arranged in a metastable state, and the plated layer does not substantially exhibit crystallinity, and also does not have magnetism in the direct current magnetic field. That is, the relative permeability $\mu_r$ is nearly equal to 1.0

The electroless-plated layer of the nickel alloy containing 5–12 wt % of phosphorus has a permeability of approximately 1.0 at 1 GHz, which is considerably lower than the permeability (approximately 3.0) of the nickel-electroplated layer discussed in the background section.

In order to verify the effects of the electroless-plated layer of nickel alloy containing phosphorus, a conventional high-frequency connector was formed for comparison. The conventional connector had a base material having the same shape and size as the connector of the exemplary embodiment according to the invention. A nickel-electroplated layer which did not contain phosphorus was formed on top of the base material, having a thickness of 2 $\mu$m. A gold plated layer with a thickness of 2 $\mu$m was further formed as a surface layer. The conventional high-frequency connector and a high-frequency connector according to the exemplary embodiment of the present invention described above were separately used for an antenna terminal of an antenna duplexer in a band of 900 MHZ in order to measure the seventh intermodulation distortion. As a result, it was found that the intermodulation distortion produced by the embodiment of the present invention was better than the conventional connector by approximately 30 dB.

In accordance with the present invention, since a housing and/or a central conductor are substantially composed of a nonmagnetic material as a whole including a surface area, the skin depth does not decrease with permeability, the concentration of electric currents on the surface layer is moderated, and thus the intermodulation distortion can be sufficiently suppressed Also, in accordance with the present invention, since the relative permeability of the surface area is nearly equal to 1.0, the intermodulation distortion due to the concentration of electric currents can be effectively suppressed.

The specification discusses the exemplary use of a nickel layer including phosphorus However, the invention also encompasses equivalent materials used to form a nonmagnetic layer or layers on the connector.

The above-described exemplary embodiments are intended to be illustrative in all respects, rather than restrictive, of the present invention. Thus the present invention is capable of many variations in detailed implementation that can be derived from the description contained herein by a person skilled in the art. All such variations and modifications are considered to be within the scope and spirit of the present invention as defined by the following claims.

What is claimed is:

1. An antenna terminal comprising:

a housing serving as an external conductor; and a central conductor, wherein at least said housing or said central conductor comprises a nonmagnetic base material onto which electroless plating of a nickel alloy containing phosphorus is applied, and a phosphorus content of said nickel alloy containing phosphorus is set at 5–12 wt %, a surface layer of gold plating formed over said nickel alloy plating.

2. A method of making an antenna terminal, comprising the steps of:

providing an external conductor and a central conductor;

using electroless plating to form a layer of nickel alloy on at least one of said external conductor or central conductor, said nickel alloy containing 5–12 wt % of phosphorus; and forming a surface layer of gold plating over said nickel alloy plating.

3. The method as claimed in claim 2, further comprising the step of having at least one of said external conductor and said central conductor formed of a nonmagnetic base material.

4. An antenna terminal comprising:

a housing serving as an external conductor; and a central conductor, wherein at least said housing or said central conductor comprises a nonmagnetic base material onto which electroless plating of a nickel alloy containing phosphorus is applied, a surface layer of gold plating formed over said nickel alloy plating, and a phosphorus content of said nickel alloy containing phosphorus is set at 5–12 wt %, and wherein a relative permeability of said electroless plating of nickel alloy containing phosphorus is substantially equal to 1.

5. A method of making an antenna terminal, comprising the steps of:

providing an external conductor and a central conductor;

using electroless plating to form a layer of nickel alloy on at least one of said external conductor or central conductor, said nickel alloy containing 5–12 wt % of phosphorus wherein a relative permeability of said electroless plating of nickel alloy containing phosphorus is substantially equal to 1; and forming a surface layer of gold plating over said nickel alloy plating.

6. The method as claimed in claim 5, further comprising the step of having at least one of said external conductor and said central conductor formed of a nonmagnetic base material.

* * * * *